United States Patent [19]

Bland et al.

[11] Patent Number: 4,699,598

[45] Date of Patent: Oct. 13, 1987

[54] MARINE PROPULSION DEVICE WATER SUPPLY SYSTEM

[75] Inventors: Gerald F. Bland, Glenview; Donald K. Sullivan, Arlington Heights, both of Ill.

[73] Assignee: Outboard Marine Corporation, Waukegan, Ill.

[21] Appl. No.: 802,132

[22] Filed: Sep. 2, 1986

Related U.S. Application Data

[63] Continuation of Ser. No. 721,671, Apr. 10, 1985, abandoned.

[51] Int. Cl.[4] ..... B63H 21/38

[52] U.S. Cl. ..... 440/88; 123/41.4

[58] Field of Search ..... 440/88, 89, 57, 43, 440/900; 123/41.14, 41.15

[56] References Cited

U.S. PATENT DOCUMENTS 2,857,892 10/1958 Hulsebus ..... 123/41.14 X 3,181,494 5/1965 Kiekhaefer et al. ..... 440/89 X 3,181,495 5/1965 Kiekhaefer ..... 440/88

FOREIGN PATENT DOCUMENTS 1161310 1/1984 Switzerland ..... 440/88

*Primary Examiner*—Joseph F. Peters, Jr.

*Assistant Examiner*—Paul E. Salmon

*Attorney, Agent, or Firm*—Michael, Best & Friedrich

[57] ABSTRACT

A marine propulsion device comprising an internal combustion engine, a propulsion unit adapted to be pivotally mounted on the transom of a boat for pivotal movement relative to the transom about a generally vertical steering axis, and about a generally horizontal tilt axis, the propulsion unit including a propeller operably connected to the engine, a pump for pumping water from the exterior of the propulsion unit to the engine, and a conduit extending from the pump to the engine and having a low point below both the pump and the connection of the conduit to engine, and a drain for draining water from adjacent the low point of the conduit.

13 Claims, 3 Drawing Figures

MARINE PROPULSION DEVICE WATER SUPPLY SYSTEM

This application is a continuation of U.S. Ser. No. 721,671, filed Apr. 10, 1985, now abandoned.

BACKGROUND OF THE INVENTION

The invention relates to water supply systems for marine propulsion devices.

Prior marine propulsion device water supply systems commonly include a pump for pumping coolant water to the engine, and a conduit extending between the pump and the engine for conducting the water to the engine. These prior water supply systems are often difficult to drain when the marine propulsion device is removed from the water for storage, and this can result in water freezing in the water supply system and damaging the marine propulsion device. Also, these prior water supply systems often complicate assembly and disasembly of marine propulsion devices because these prior water supply systems must also be assembled and disassembled.

Attention is directed to Bland U.S. Pat. No. 4,565,534 granted Jan. 21, 1986 and titled "Water Pump Location for Marine Propulsion Device."

SUMMARY OF THE INVENTION

The invention provides a marine propulsion device comprising an internal combustion engine, a propulsion unit adapted to be pivotally mounted on the transom of a boat for pivotal movement relative to the transom about a generally vertical steering axis, and about a generally horizontal tilt axis, the propulsion unit including a propeller operably connected to the engine, means for pumping water from the exterior of the propulsion unit to the engine and including a pump, and conduit means extending from the pump to the engine, and means for draining water from the conduit means.

In one embodiment, the conduit means has a low point below both the pump and the connection of the conduit means to the engine, and the draining means affords drainage of water from adjacent the low point of the conduit means.

In one embodiment, the device further comprises a pivot housing adapted to be pivotally mounted on the transom for pivotal movement about the steering and tilting axes, the propulsion unit is removably secured to the pivot housing for pivotal movement therewith, the pump is located in the propulsion unit, and the conduit means extends from the pump through the pivot housing to the engine.

In one embodiment, the draining means includes an opening in the conduit means, and a drain plug removably secured in the opening.

In one embodiment, the marine propulsion device has an exterior, and the drain plug is accessible from the exterior of the marine propulsion device.

The invention also provides a marine propulsion device comprising an internal combustion engine, means for pumping water to the engine and including a pump, and conduit means extending from the pump to the engine and having a low point below both the pump and the connection of the conduit means to the engine, and means for draining water from adjacent the low point of the conduit means.

The invention also provides a marine propulsion device comprising an internal combustion engine, a pivot housing adapted to be pivotally mounted on the transom of a boat for pivotal movement relative to the transom about a generally vertical steering axis, and about a generally horizontal tilt axis, the pivot housing including a rear end, an opening communicable with the atmosphere, a conduit member having opposite front and rear ends and a drain opening intermediate the ends and communicating with the opening in the pivot housing so as to be communicable with the atmosphere, the rear end of the conduit member extending rearwardly of the rear end of the pivot housing, and a drain plug removably securable in the opening in the pivot housing so as to prevent communication between the drain opening and the atmosphere, a first conduit communicating between the front end of the conduit member and the engine for conducting water from the conduit member to the engine, and a propulsion unit removably connected to the pivot housing for pivotal movement therewith, the propulsion unit including a front end connected to the rear end of the pivot housing, a propeller operably connected to the engine, a pump for pumping water to the engine, an opening in the front end of the propulsion unit, and a second conduit communicating between the opening and the pump, the opening being located such that the rear end of the conduit member extends into the opening and communicates with the second conduit when the propulsion unit is connected to the pivot housing, whereby the second conduit is automatically connected to the rear end of the conduit member when the propulsion unit is connected to the pivot housing, and is automatically disconnected from the conduit member when the propulsion unit is disconnected from the pivot housing.

In one embodiment, the first and second conduits and the conduit member have a low point below both the pump and the connection of the first conduit to the engine, and the drain opening in the conduit member is located adjacent the low point.

The invention also provides a marine propulsion device comprising a pivot housing having a rear end and being adapted to be pivotally mounted on the transom of a boat for pivotal movement relative to the transom about a generally vertical steering axis, and about a generally horizontal tilt axis, an internal combustion engine, a first conduit communicating between the engine and the rear end of the pivot housing, and a propulsion unit having a forward end removably connected to the rear end of the pivot housing, the propulsion unit including a propeller operably connected to the engine, a pump for pumping water to the engine, and a second conduit communicating between the pump and the forward end of the propulsion unit, the second conduit being automatically connected to the first conduit when the propulsion unit is connected to the pivot housing, and being automatically disconnected from the first conduit when the propulsion unit is disconnected from the pivot housing.

A principal feature of the invention is the provision of a marine propulsion device comprising means for pumping water from the exterior of the propulsion unit to the engine and including a pump, and conduit means extending from the pump to the engine, the conduit means having a low point below both the pump and the connection of the conduit means to engine, and means for draining water from adjacent the low point of the conduit means.

Another principal feature of the invention is the provision of a marine propulsion device comprising a pivot housing including a rear end, an opening communicable with the atmosphere, a conduit member having opposite front and rear ends and a drain opening intermediate the ends and communicating with the opening in the pivot housing so as to be communicable with the atmosphere, and a drain plug removably securable in the opening in the pivot housing so as to prevent communication between the drain opening and the atmosphere, a first conduit communicating between the front end of the conduit member and the engine, and a propulsion unit including a front end connected to the rear end of the pivot housing, a pump for pumping water to the engine, an opening in the front end of the propulsion unit, and a second conduit communicating with the pump for conducting water from the pump to the conduit member, the second conduit being automatically connected to the rear end of the conduit member when the propulsion unit is connected to the pivot housing, and being automatically disconnected from the conduit member when the propulsion unit is disconnected from the pivot housing.

Other features and advantages of the invention will become apparent to those skilled in the art upon review of the following detailed description, claims and drawings.

Figure 1:
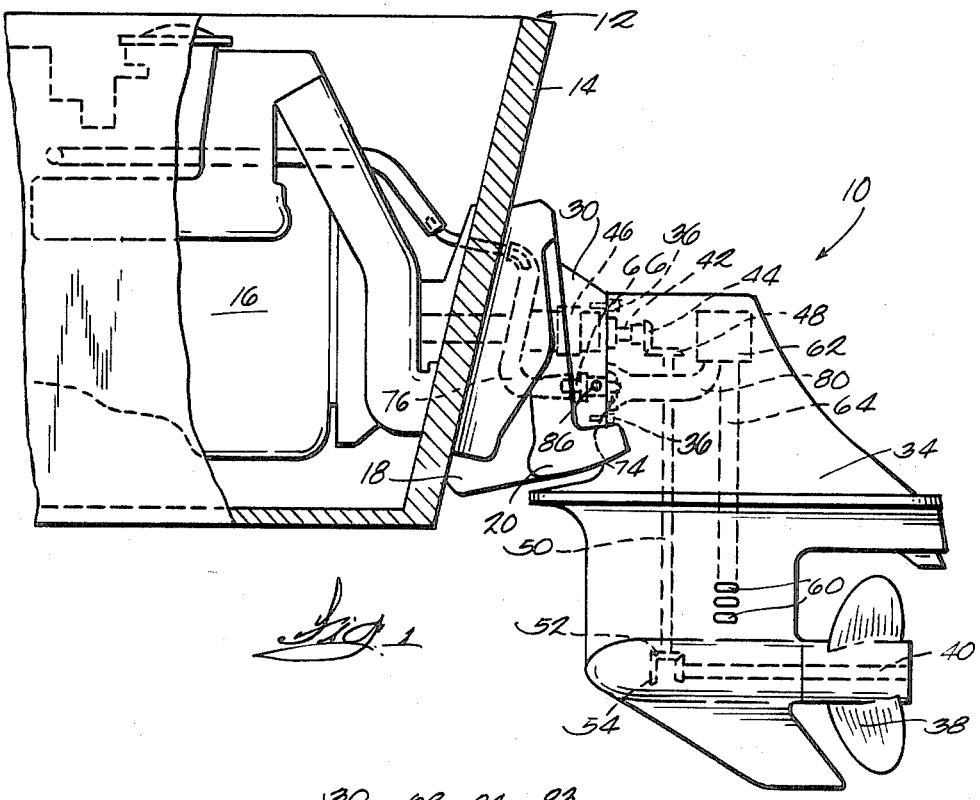
FIG. 1 is a side elevational view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Illustrated in the drawings is a marine propulsion device 10 mounted on a boat 12 having a transom 14. The marine propulsion device 10 is of the stern drive or inboard/outboard type.

As best shown in FIG. 1, the marine propulsion device 10 comprises a water cooled engine 16 securely mounted on the boat frame by suitable means such as rubber mounts (not shown). The marine propulsion device 10 also comprises a gimbal housing 18 mounted on the outer surface of the boat transom 14 and fixedly attached to the boat transom 14. The gimbal housing 18 can be attached to the boat transom 14 by any suitable means, such as bolts extending through the transom 14.

The marine propulsion device 10 also comprises a gimbal ring 20 connected to the gimbal housing 18 for pivotal movement relative to the gimbal housing 18 about a generally vertical steering axis (not shown), and a pivot housing 30 connected to the gimbal ring 20 for pivotal movement relative to the gimbal ring 20 about a generally horizontal tilt axis (not shown). Such a construction is well known in the art and need not be described in greater detail.

The marine propulsion housing or device 10 also comprises a propulsion unit 34 which, together with the pivot housing 30, constitutes a propulsion assembly and which is removably connected to the pivot housing 30 for common pivotal movement of the propulsion unit 34 with the pivot housing 30. In the illustrated construction, the propulsion unit 34 is removably connected to the pivot housing 30 by a plurality of bolts 36. Both the pivot housing 30 and the propulsion housing or unit 34 have, as shown in the drawings, exterior side faces. The propulsion housing or unit 34 includes a propeller 38 mounted on a propeller shaft 40, and a generally horizontal drive shaft 42 having one end removably connected to the engine 16 and an opposite end having thereon a bevel gear 44. A universal joint 46 attached to the horizontal drive shaft 42 allows pivotal movement of the drive shaft 42 with the propulsion unit 34. The bevel gear 44 drives a bevel gear 48 on the upper end of a vertical drive shaft 50. The lower end of the vertical drive shaft 50 has thereon a driving gear 52. A reversible transmission selectively clutches a pair of driven gears 54 to the propeller shaft 40 to transmit forward or reverse motion to the propeller shaft 40 from the driving gear 52.

The marine propulsion device 10 further comprises means for pumping water from the exterior of the propulsion unit 34 to the engine 16. The means for pumping water includes a plurality of water inlet openings 60 in the propulsion unit 34, the inlet openings 60 being located so as to be underwater during normal operation of the marine propulsion device 10. The pumping means also includes a pump 62, and an inlet passage 64 communicating between the pump 62 and the inlet openings 60. In the illustrated construction, the pump 62 is located rearwardly of the horizontal drive shaft 42 and is driven by an extension of the horizontal drive shaft 42. Such a pump location is described in greater detail in the above mentioned Bland U.S. Pat. No. 4,565,534 granted Jan. 21, 1987 which is incorporated herein by reference. It should be understood that other pump locations and other means for driving the pump are within the scope of the invention.

The pumping means also includes conduit means extending from the pump 62 to the engine 16. While various suitable conduit means can be employed, in the preferred embodiment, the conduit means includes a conduit member 66 (see FIG. 2) mounted in an opening 68 in the pivot housing 30, the conduit member 66 having opposite front and rear ends and a drain opening 70. A pair of O-rings 72 seal the joint between the conduit member 66 and the opening 68. A shoulder 73 on the conduit member 66 engages the pivot housing 30 at the forward end of the opening 68. The rear end (to the right in FIG. 2) of the conduit member 66 is externally threaded, and the conduit member 66 is secured in the opening 68 in the pivot housing 30 by a nut 74 threaded onto the rear end of the conduit member 66. The conduit member 66 is mounted in the pivot housing 30 such that the rear end of the conduit member 66 extends rearwardly of the rear end of the pivot housing 30. The front end (to the left in FIG. 2) of the conduit member 66 forms a nipple.

Figure 3:
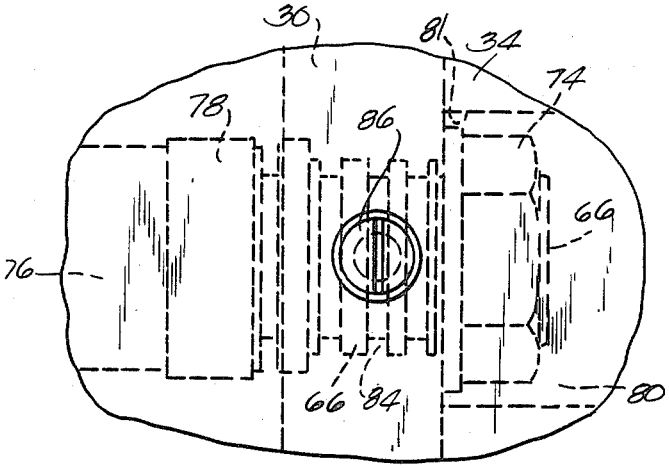
FIG. 3 is an enlarged, partial view of the pivot housing and propulsion unit showing the conduit member.

The conduit means also includes a first conduit or water hose 76 communicating between the front end of the conduit member 66 and the engine 16 for conducting water from the conduit member 66 to the engine 16. The water hose 76 is secured to the nipple formed by the front end of the conduit member 66 by a conventional band clamp 78. The water hose 76 extends through the gimbal ring 20, through an opening (not shown) in the gimbal housing 18, and through an opening (not shown) in the transom 14 to the engine 16. The conduit means further includes a second conduit communicating with the pump 62 for conducting water from the pump 62 to the conduit member 66, the second conduit being automatically connected to the rear end of the conduit member 66 when the propulsion unit 34 is connected to the pivot housing 30, and being automatically disconnected from the conduit member 66 when the propulsion unit 34 is disconnected from the pivot housing 30. In the preferred embodiment, the second conduit is a water supply cavity or recess 80 (see FIG. 1) communicating between the pump 62 and an opening 81 (see FIG. 3) in the front end of the propulsion unit 34. The water supply cavity 80 and the conduit member 66 are located such that the rear end of the conduit member 66 extends into the water supply cavity 80 when the propulsion unit 34 is connected to the pivot housing 30. Therefore, the water supply cavity 80 automatically communicates with the conduit member 66 when the propulsion unit 34 is connected to the pivot housing 30. A seal 83 surrounds the opening 81 and seals the joint between the pivot housing 30 and the propulsion unit 34 so that the water supply cavity 80 sealingly communicates with the conduit member 66.

Figure 2:
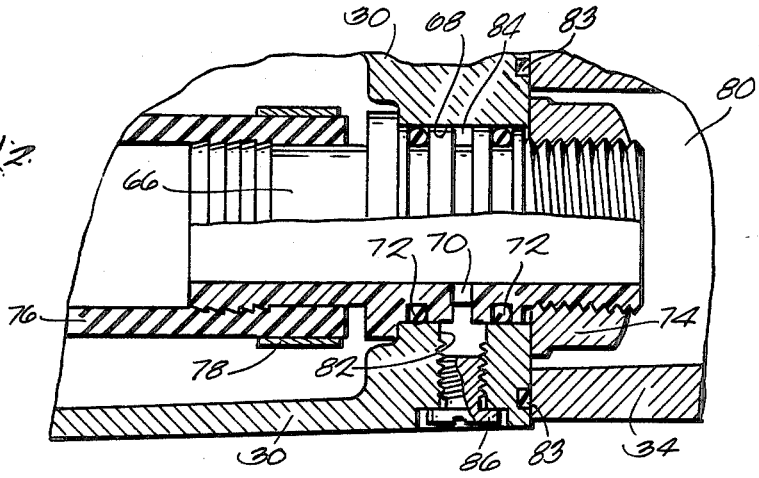
FIG. 2 is an enlarged, partial cross sectional view taken from above the conduit member.

The marine propulsion device 10 further comprises means for draining water from the conduit means and, as shown in the drawings, includes a branch duct extending from a portion of the conduit means intermediate the pump 62 and the engine 16. More particularly, in the preferred embodiment, the draining means includes, in the pivot housing 30, an internally threaded opening 82 (see FIG. 2) communicable with one of the side faces of the propulsion assembly and, in the conduit member 66, the drain opening 70 communicating with the opening 82 in the pivot housing 30 so as to be communicable with the atmosphere. The conduit member 66 has a drain groove 84 communicating with the drain opening 70 and running circumferentially around the conduit member 66 to insure communication of the drain opening 70 with the opening 82 in the event that the conduit member 66 is rotated such that the drain opening 70 is not aligned with the opening 82. The draining means further includes a drain plug 86 removably and threadably securable in the opening 82 in the pivot housing 30 so as to prevent communication between the drain opening 70 and the atmosphere. As best shown in FIG. 2, the drain plug 86 is inserted into the opening 82 from the exterior of the pivot housing 30 and is accessible from the exterior of the pivot housing 30.

In the preferred embodiment, the conduit means has a low point below both the pump 62 and the connection of the conduit means to the engine 16, and the draining means affords drainage of water from adjacent the low point of the conduit means. Thus, the first and second conduits (the water hose 76 and the water supply cavity 80) and the conduit member 66 have a low point between both the pump 62 and the engine 16, and the drain opening 70 in the conduit member 66 is located adjacent the low point.

The marine propulsion device 10 functions as follows. When the propulsion unit 34 is connected to the pivot housing 30, the water supply cavity 80 is automatically connected to the rear end of the conduit member 66, so that the pump 62 is connected to the engine 16 via the water supply cavity 80, the conduit member 66, and the water hose 76. When the marine propulsion device 10 is removed from the water for storage, any water between the pump 62 and the inlet openings 60 will drain out through the inlet openings 60. When the drain plug 86 is removed from the pivot housing 30, substantially all water between the pump 62 and the engine 16 (in the water supply cavity 80, the conduit member 66, or the water hose 76) will drain out through the drain opening 70 and the opening 82. Since the drain opening 70 is located adjacent the low point of the conduit means, virtually all of the water between the pump 62 and the engine 16 will be drained. This will substantially prevent freezing of water in the water supply system and damage to the marine propulsion device 10 due to expansion of frozen water in the water supply system. Water in the engine 16 is drained in the conventional manner, such as by opening petcocks on the engine 16.

When the propulsion unit 34 is disconnected from the pivot housing 30, the water supply cavity 80 is automatically disconnected from the rear end of the conduit member 66. No other disassembly of the water supply system is necessary.

Various other features of the invention are set forth in the following claims:

We claim:

1. A marine propulsion device comprising an internal combustion engine, a propulsion assembly adapted to be pivotally mounted on the transom of a boat for pivotal movement relative to the transom out a generally vertical steering axis, and about a generally horizontal tilt axis, said propulsion assembly including a housing having an exterior side face, a propeller supported by said housing and operably connected to said engine, means in said housing for pumping water from the exterior of said propulsion unit to said engine and including a pump, conduit means extending in said housing from said pump to said engine and including a portion intermediate said pump and said engine, and means in said propulsion assembly including a branch duct communicating between said intermediate portion of said conduit means and said housing exterior side face, and a selectively movable member removably received in said branch duct and accessible from the exterior of said propulsion assembly for selectively draining water through said branch duct from said conduit means.

2. A marine propulsion device as set forth in claim 1 wherein said conduit means has a low point below both said pump and the connection of said conduit means to said engine, and wherein said branch duct communicates with said low point of said conduit means.

3. A marine propulsion device as set forth in claim 1 wherein said housing comprising a pivot housing adapted to be pivotally mounted on the transom for pivotal movement about said steering and tilting axes, and a propulsion unit removably secured to said pivot housing for pivotal movement therewith, wherein said pump is located in said propulsion unit, and wherein said conduit means extends from said pump through said pivot housing to said engine.

4. A marine propulsion device as set forth in claim 3 wherein said conduit means has a low point below both said pump and the connection of said conduit means to said engine, and wherein said branch duct communicates with said low point of said conduit means.

5. A marine propulsion device as set forth in claim 4 wherein said member comprises a drain plug removably secured in said branch duct.

6. A marine propulsion device comprising and internal combustion engine, a propulsion assembly adapted to be supported for tilting and steering movement relative to a boat transom and including opposite exterior side faces, means for pumping water to said engine and including a pump located in said propulsion assembly, and conduit means extending from said pump to said engine and including a portion which is intermediate said pump and said engine and which has a low point spaced from and below both said pump and the connection of said conduit means to said engine, and means including a branch duct communicating between said low point and one of said side faces and including a selectively movable member removably located in said branch duct and accessible from the exterior for draining water from adjacent said low point of said conduit means.

7. A marine propulsion device comprising an internal combustion engine, a pivot housing adapted to be pivotally mounted on the transom of a boat for pivotal movement relative to the transom about a generally vertical steering axis, and about a generally horizontal tilt axis, said pivot housing including a rear end, and an opening communicating with the atmosphere, a conduit member extending in said pivot housing and having opposite front and rear ends, said rear end of said conduit member extending rearwardly of said rear end of said pivot housing, said conduit member also including a drain opening communicating with said opening in said pivot housing so as to be communicable with the atmosphere, a drain plug removably securable in said opening in said pivot housing so as to prevent communication between said drain opening and the atmosphere, a first conduit communicating between said front end of said conduit member and said engine for conducting water from said conduit member to said engine, and a propulsion unit removably connected to said pivot housing for pivotal movement therewith, said propulsion unit including a front end connected to said rear end of said pivot housing, a propeller operably connected to said engine, a pump for pumping water to said engine, an opening in said front end of said propulsion unit, and a second conduit communicating between said opening in said front end of said propulsion unit and said pump, said opening in said front end of said propulsion unit being located such that said rear end of said conduit member extends into said opening in said front end of said propulsion unit and communicates with said second conduit when said propulsion unit is connected to said pivot housing, whereby communication of said second conduit with said rear end of said conduit member is effected when said propulsion unit is connected to said pivot housing.

8. A marine propulsion device as set forth in claim 7 wherein said first and second conduits and said conduit member have a low point below both said pump and the connection of said first conduit to said engine, and wherein said drain opening in said conduit member is located adjacent said low point.

9. A marine propulsion device as set forth in claim 7 wherein said propulsion unit is removably connected to said pivot housing by a plurality of bolts.

10. A marine propulsion device as set forth in claim 7 wherein said pivot housing includes a conduit opening in said rear end of said pivot housing, wherein said conduit member is located in said conduit opening, wherein said rear end of said conduit member is externally threaded, wherein said conduit member includes a shoulder engaging said pivot housing adjacent the front end of said conduit opening, and wherein said conduit member is secured in said conduit opening by a nut threaded onto said rear end of said conduit member and engaging said pivot housing adjacent the rear end of said conduit opening.

11. A marine propulsion device as set forth in claim 10 wherein said conduit member also has an annular drain groove extending circumferentially around said conduit member and communicating with said drain opening to insure communication of said drain opening with said opening in said pivot housing in the event that said conduit member is rotated such that said drain opening is not aligned with said opening in said pivot housing.

12. A marine propulsion device comprising a pivot housing adapted to be pivotally mounted on the transom of a boat and including a rear end, a conduit extending in said pivot housing and having a rear end, a drain opening in said pivot housing communicating with said conduit and with the atmosphere, a drain plug removably securable in said drain opening so as to prevent communication between said conduit and the atmosphere, and a propulsion unit removably connected to said pivot housing and including a front end connected to said rear end of said pivot housing, and a recess located in said front end of said propulsion unit such that said rear end of said conduit communicates with said recess when said propulsion unit is connected to said pivot housing.

13. A marine propulsion device comprising a propulsion assembly having opposite exterior side faces and including a pivot housing adapted to be pivotally mounted on the transom of a boat and including a rear end, a propulsion unit removably connected to said pivot housing and including a pump, and a front end connected to said rear end of said pivot housing, conduit means in said pivot housing and in said propulsion unit and including a duct extending in said pivot housing and having a rear end, and a recess in said propulsion unit, communicating with said pump, and having an end located in said front end of said propulsion unit and positioned such that said recess communicates with said rear end of said duct when said propulsion unit is connected to said pivot housing, said conduit also including a portion intermediate said engine and said pump and including a part of said duct and of said recess, and drainage means located in one of said pivot housing and said propulsion unit and including a branch duct communicating between said intermediate portion of said conduit means and one of said side faces and including a removable drain plug removably located in said duct and accessible from the exterior of said one of said side faces of said propulsion assembly.

* * * * *